United States Patent [19]

Reckin et al.

[11] 4,291,500

[45] Sep. 29, 1981

[54] APPARATUS FOR OPENING AND CLOSING AIR LOCK DOORS

[75] Inventors: George M. Reckin, Delafield; Richard A. Lofy, Elm Grove; Robert S. Dean, Wauwatosa, all of Wis.

[73] Assignee: Lakeside Bridge & Steel Co., Milwaukee, Wis.

[21] Appl. No.: 71,233

[22] Filed: Aug. 30, 1979

[51] Int. Cl.[3] ..... E06B 7/00

[52] U.S. Cl. ..... 49/68; 74/53

[58] Field of Search ..... 49/13, 14, 29, 68, 107, 49/108, 340; 74/53

[56] References Cited

U.S. PATENT DOCUMENTS

| | | | |
|---|---|---|---|
| 2,927,787 | 3/1960 | Maher | 49/68 X |
| 3,032,835 | 5/1962 | Saar et al. . | |
| 3,678,624 | 7/1972 | Bicicchi . | |
| 3,922,925 | 12/1975 | Takel et al. | 74/53 |
| 3,929,568 | 12/1975 | Schabert et al. . | |

FOREIGN PATENT DOCUMENTS

| | | | |
|---|---|---|---|
| 2543744 | 10/1975 | Fed. Rep. of Germany | 49/68 |

*Primary Examiner*—Kenneth Downey
*Attorney, Agent, or Firm*—Quarles & Brady

[57] ABSTRACT

A personnel air lock has a transfer chamber that is separated from an atmospheric region by an outside door and is separated from a containment region by an inside door. A single drive shaft couples a motor and three clutch-operable hand wheels to the doors to sequentially open and close one door and then the other. Each door is opened and closed through a door actuator linkage that is coupled to the drive shaft through a respective dual clutch and a respective clutch-actuating mechanism. One door-opening clutch is engaged as a lead screw nut moves through an active range along a timing lead screw, while another door-opening clutch is disengaged as an associated lead screw nut moves through an inactive range along another timing lead screw, so that only one of the doors is coupled to the drive shaft at a time. Each lead screw nut forms part of a slide indicator for indicating the operating position of its associated door. An air lock with this door sequencing mechanism is particularly useful in providing ingress and egress for a nuclear containment vessel.

20 Claims, 9 Drawing Figures

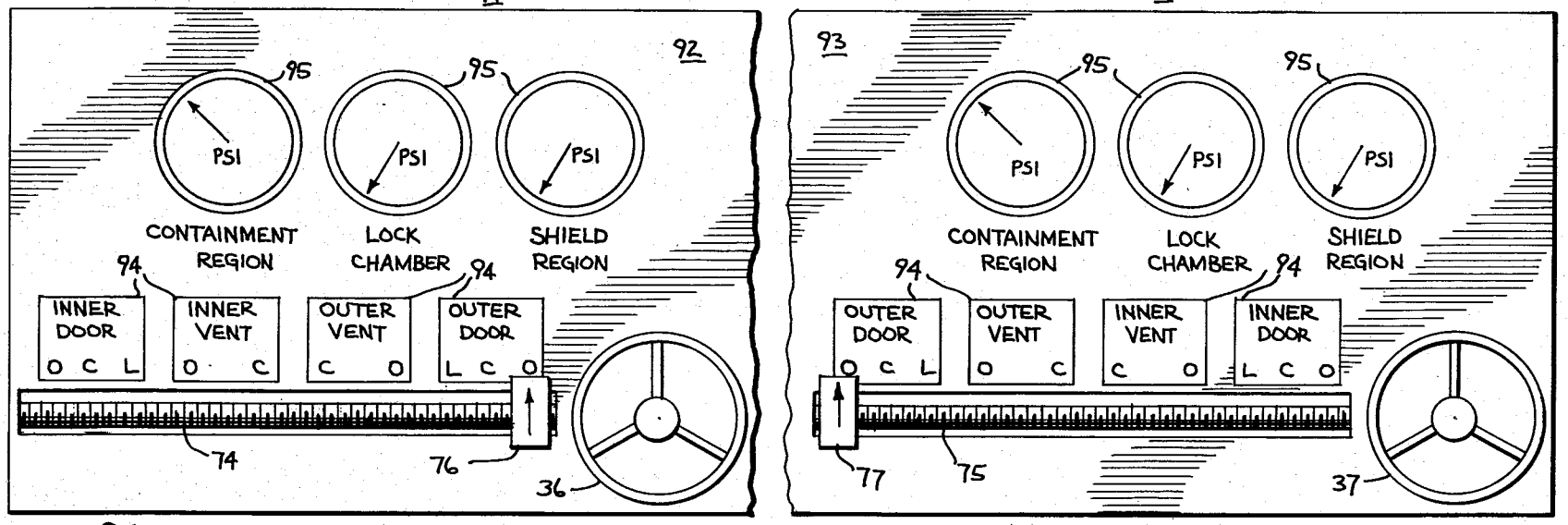
fig. 2
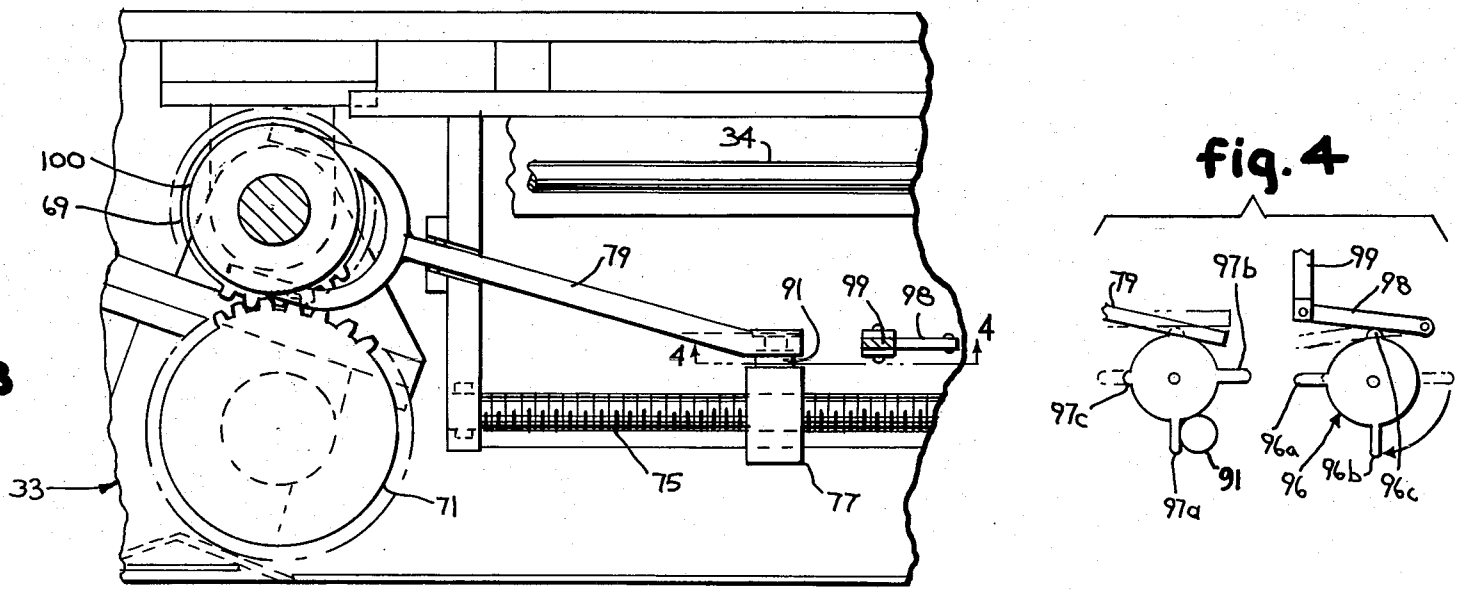
fig. 3
fig. 4 fig. 6
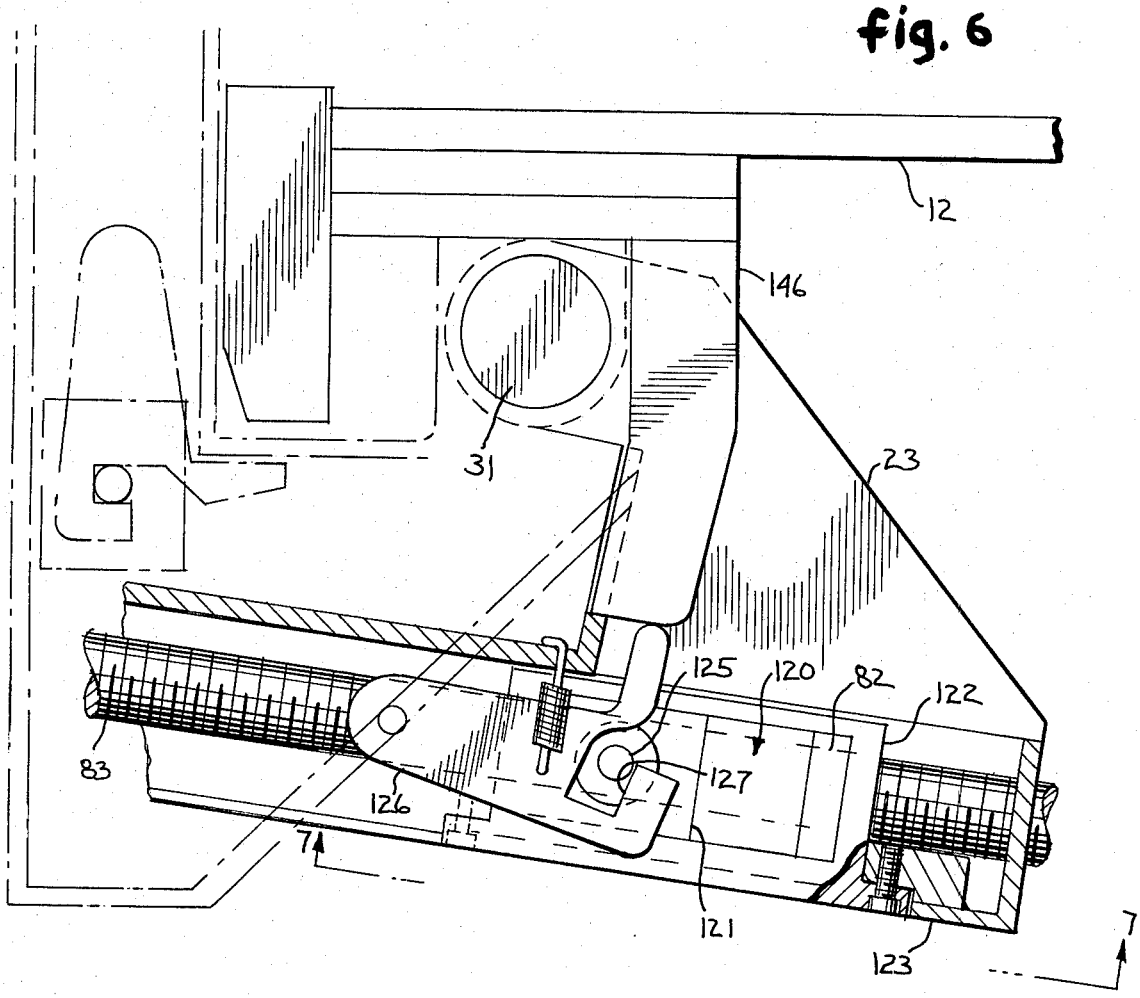
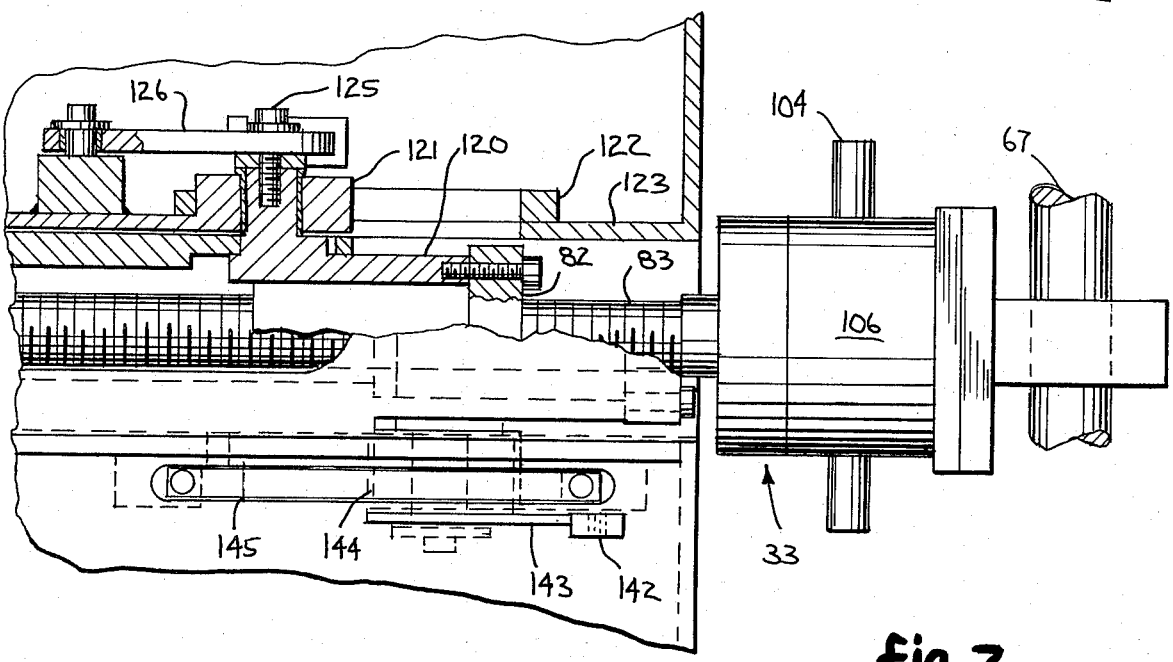
fig. 7

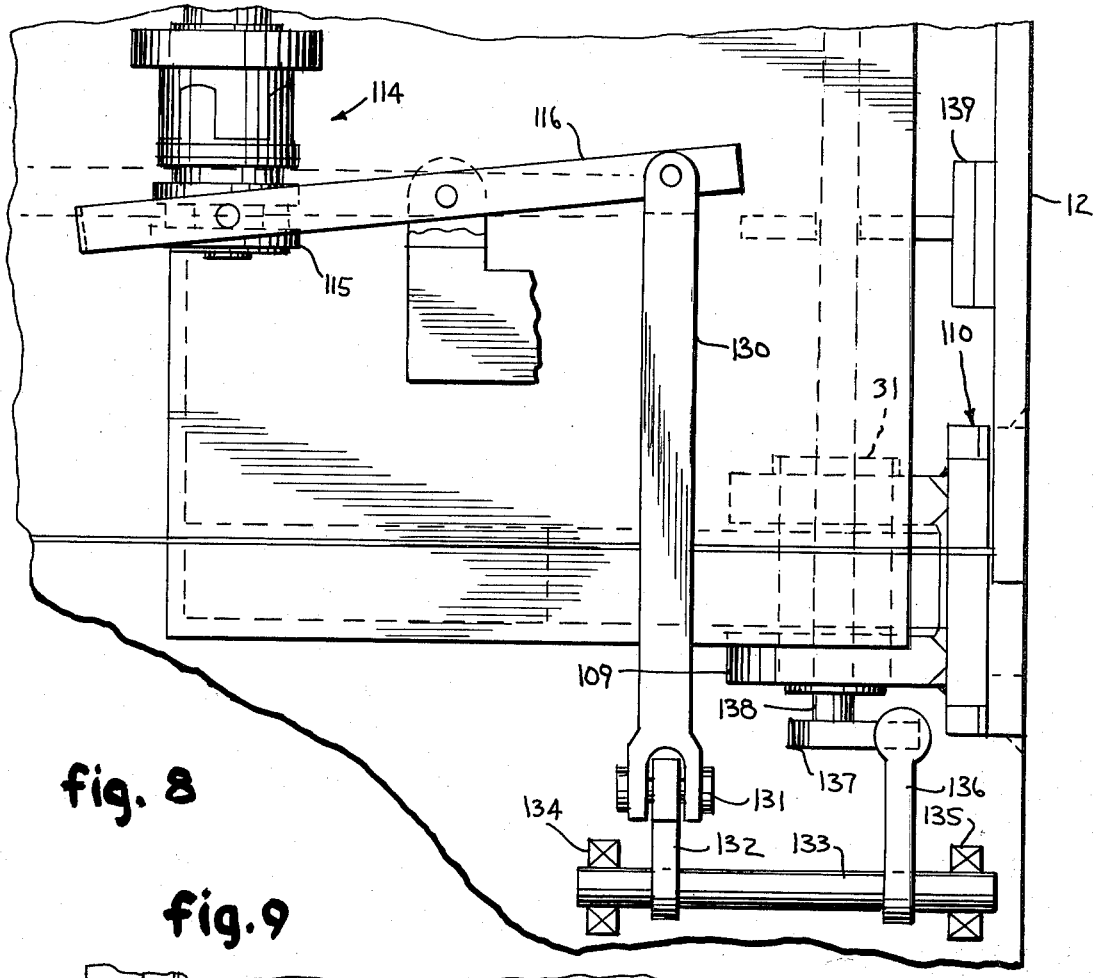
fig. 8
fig. 9
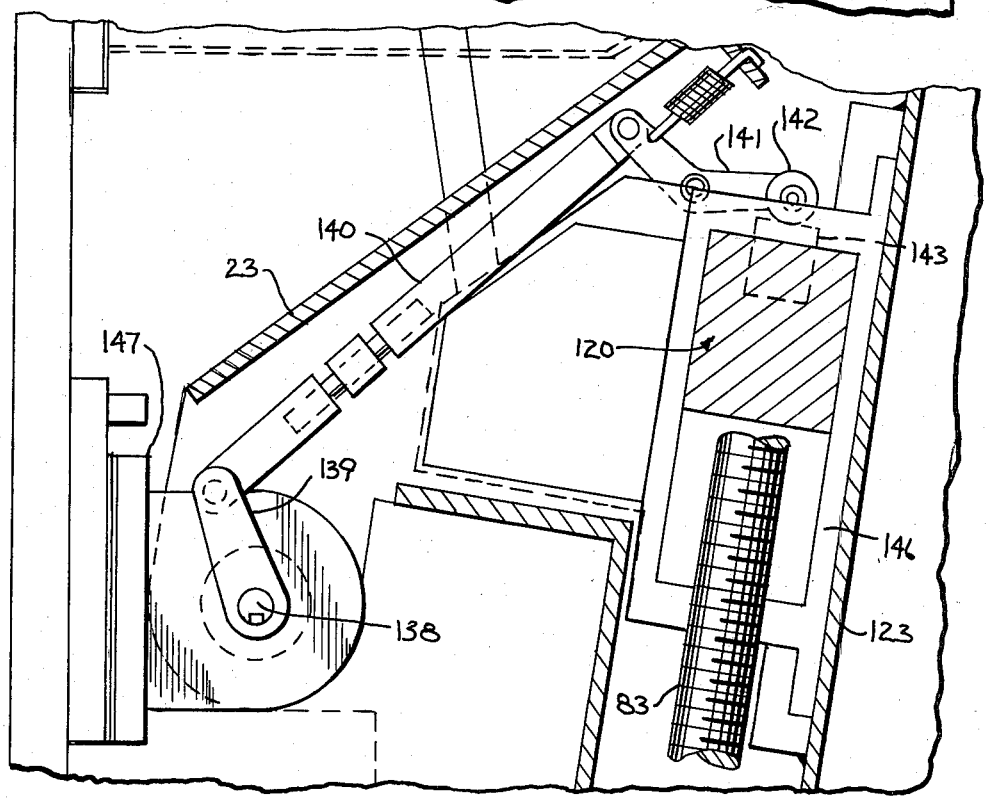

APPARATUS FOR OPENING AND CLOSING AIR LOCK DOORS

BACKGROUND OF THE INVENTION

1. Field of the Invention

The field of the invention is multiple-door personnel air locks of the type that are built into containment vessels to allow passage into or out of a pressurized or vacuum containment region without breaking the isolation of the containment region from the outside environment.

2. Description of the Prior Art

An air lock is an airtight compartment with a transfer chamber of sufficient size to hold a number of men that must be accommodated in it at one time. It is provided with well-braced doors having sealing-type edges and tightening locks. The chamber is equipped with valves for admitting and releasing air and the air lock generally has two airtight doors, one leading to the atmosphere, and the other leading to a pressurized or vacuum containment region. These doors open inwardly so that the pressure in the air lock tends to tighten them against the frame. To enter a non-atmospheric containment region, in a nuclear containment vessel, for example, the workmen enter the air lock, after which the door leading to the atmosphere is tightly fastened. Air is then slowly transferred until the pressure in the air lock equals that in the containment vessel, after which the inner door may be opened without trouble or loss of air from the containment vessel. Once personnel are inside the containment vessel and the inner door is tightly closed, the outer door may again be opened without affecting conditions in the containment vessel. When leaving the containment vessel the inner door is closed and air is exhausted from the transfer chamber to return it to atmospheric pressure before the outer door is opened.

In Takei, et al, U.S. Pat. No. 3,922,925, issued Dec. 2, 1975, a door control system is disclosed wherein both doors can be operated in sequence by any one of three handwheels. This sequence is controlled by the rotation of a pair of cam discs that are each coupled by a plurality of lever arms to the door hinge, door latch and vent valve mechanisms for the inner and outer doors, respectively. This system also employs a pair of main drive shafts each coupled to a corresponding door, and these drive shafts are coupled through a reversing gear mechanism so that the two main shafts rotate in opposite directions. A pair of clutches are disengaged to break the interlock along each of the main drive shafts so that the inner and outer pressure doors can be opened simultaneously in case of an emergency.

SUMMARY OF THE INVENTION

The invention provides an air lock door sequencing mechanism that maintains the interlock between three handwheels through a single drive shaft. The handwheels are located in a containment region, in an air lock transfer chamber,and in an atmospheric region, respectively. The air locks doors are driven in sequence from any one of the handwheels, with one of the doors being locked to maintain the isolation of the containment region while the other door is being opened, and vice versa. The invention also provides a lead screw timing mechanism for sequentially operating the inner and outer doors of the air lock and, as a further enhancement of the invention, this lead screw timing mechanism forms part of a slide-type, door-position indicator, which shows the operating position of the doors.

Each of the doors is coupled to a respective door actuator for operation between a locked, closed position and an open position. Each of the door actuators is coupled by a clutch mechanism to a single main drive shaft, which is also coupled to a pair of rotatable, timing lead screws. A lead screw nut is mounted on each lead screw and moves in an active range between a neutral position and one end of the lead screw to operate an associated clutch mechanism, the lead screw nut being ineffectual in operating the clutch mechanism when it is moved in an inactive range between the neutral position and the other end of its associated lead screw. Each clutch-actuating mechanism controls the engagement and disengagement of the clutch mechanism associated with a respective door in response to the movement of a respective lead screw nut. The two lead screw assemblies are adapted so that one lead screw nut moves in its active range to operate its associted door while the other lead screw nut moves in its inactive range so that the other door is held in its closed, locked position.

The present invention allows an entire door opening and closing sequence to be controlled from any one of three handwheels, which are positioned in the containment region, in the transfer chamber, and in the atmospheric region, respectively, or by a motor coupled to the drive shaft for automatic operation. The lead screw nuts, one of which is located in the atmospheric region and the other of which is located in the transfer chamber, can be driven through the main shaft by any one of the handwheels. The lead screw nuts also form pointers that are part of slide indicators on control panels at their respective locations. These control panels allow observation of the operating position of the doors during the door opening and closing sequence. Besides controlling the doors, the timing mechanism also controls the opening and closing of vent valves that are used to equalize pressure between the transfer chamber and the region to be entered through the door that is about to be opened. The control panel includes air pressure gauges from which the operator can observe the pressure in the various regions separated by the air lock doors.

Each of the clutch mechanisms includes both a dooropening clutch and a door-closing clutch. From the time that the door-opening motion is started until it is closed and locked, both clutches are engaged and the door is under positive control in both directions. In other words, the drive never "lets go" of the door until closing and latching is accomplished. This allows the doors to be stopped at any point in the door opening and closing sequence and driven in the reverse direction either manually or automatically. Due to the overlap in the engagement cycle for the door-opening clutch with that of the door-closing clutch, a unidirectional (overrunning) sprag clutch is coupled in series between the door-opening clutch and the door actuator. Actions to engage and disengage the door-opening clutch are provided by the lead screw timing assemblies, while the door-closing clutch is engaged and disengaged in response to the movement of the door actuator during the first portion of the unlatching cycle and the last portion of the latching cycle.

The door actuators operate door latching mechanisms as well as driving the doors to their open and closed positions. The latching mechanisms are driven to an unlocked position through the door-opening clutches before the door-closing clutches are engaged, and conversely, the latching mechanisms are driven to a locked position by the door-closing clutches.

This door control system provides strong driving forces for locking and unlocking the doors as well as opening and closing the doors. All of the door-opening mechanisms are located on the opposite-from-containment side of each door. The system lends itself to the use of high reliability, heavy duty components, some of which are commercially available. The handwheels are coupled to the main shaft through clutches that are disengaged and locked when the handwheels are not being operated. The position indicators are easily calibrated during installation and easily recalibrated if one of the doors is decoupled for simultaneous door opening during scheduled maintenance periods.

These and other objects and advantages of the invention will appear from the following description wherein reference is made to the accompanying drawings that illustrate a preferred embodiment of the invention. Such embodiment does not necessarily represent the full scope of the invention, which is defined by the claims following the description.

BRIEF DESCRIPTION OF THE DRAWINGS

FIG. 2 is an elevational view of the control panels located at two of the handwheel stations seen in FIG. 1;

FIG. 3 is a plan view of a clutch-actuating mechanism of FIG. 1;

FIG. 4 is a detail view taken in the plane indicated by line 4—4 in FIG. 3.

FIG. 6 is a plan view of a portion of the outer door actuator of FIG. 1;

FIG. 7 is a side elevational view of the portion of the outer door actuator seen in FIG. 6 with parts broken away;

FIG. 8 is a side elevational view of part of a clutchactuating mechanism that operates the door-closing clutch of FIG. 5; and FIG. 9 is a plan view of another part of the clutchactuating mechanism of FIG. 8.

DETAILED DESCRIPTION OF THE PREFERRED EMBODIMENT

Figure 1:
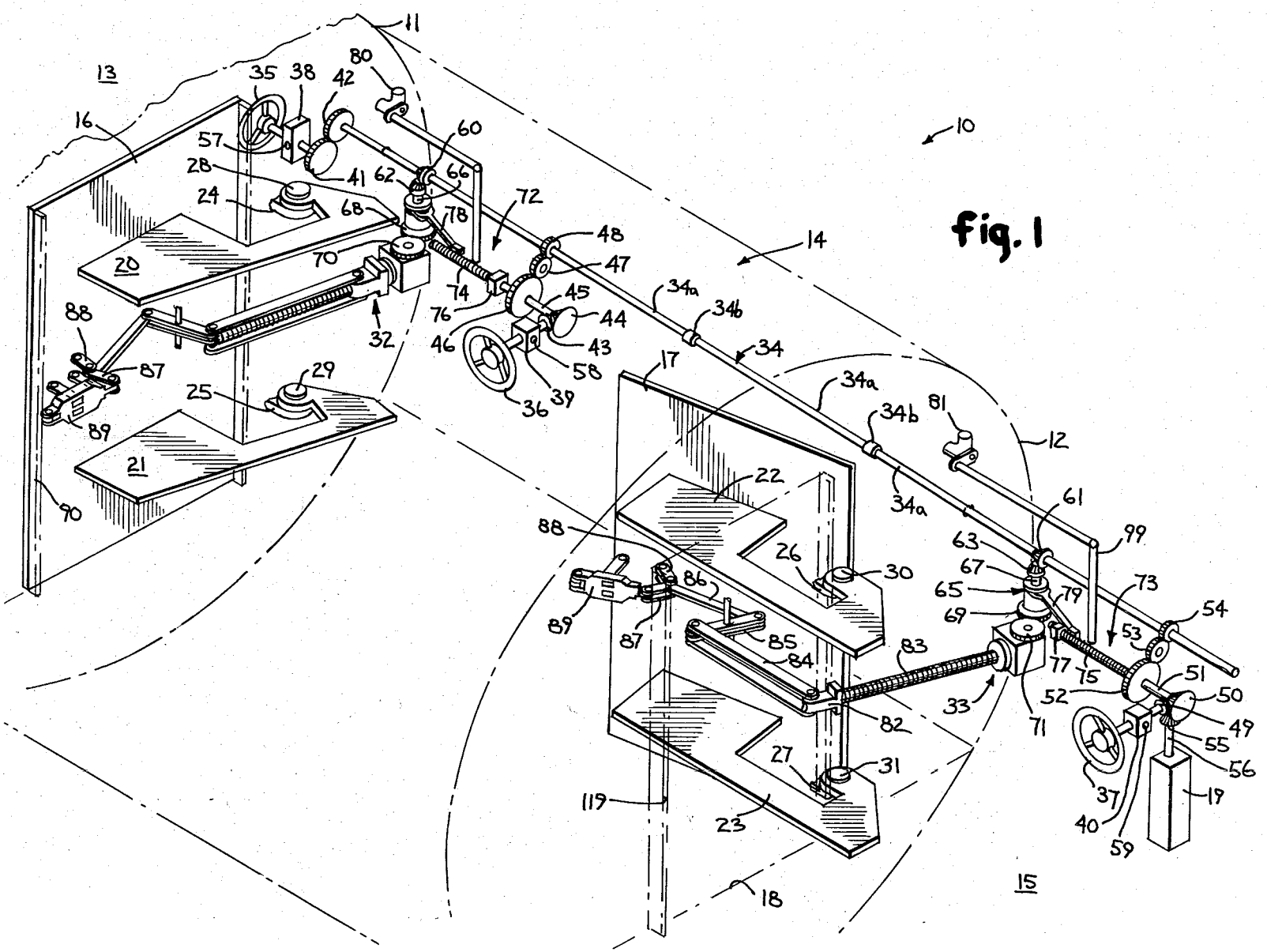
FIG. 1 is a perspective schematic view of the door sequencing mechanism of the present invention.

In FIG. 1, an air lock 10 that is generally cylindrical in shape has inner and outer bulkheads 11 and 12 at its respective ends. The air lock 10 is built into a containment vessel (not shown), so that the inner bulkhead separates a containment region 13, which is maintained at a nonatmospheric pressure, from a locked transfer chamber 14 between the two bulkheads 11 and 12. The outer bulkhead 12 separates the transfer chamber 14 from an atmospheric region 15 to the outside, which is to be shielded and isolated from the containment region 13. The air lock 10 has inner and outer doors 16 an 17 that open and close in doorways in the inner and outer bulkheads 11 and 12, respectively, a doorway 18 in the outer bulkhead 12 being outlined in phantom in FIG. 1. Each of the doors 16 and 17 is supported by a pair of vertically spaced apart main hinge supports 20–21 and 22–23, which are mounted on brackets 24–25 and 26–27 on the inner and outer bulkheads 11 and 12 by hinge pins 28–31. Both of the doors 16 and 17 open inwardly towards the containment region 13, with all supporting and latching hardware being attached to the opposite-from-containment side of each door. This arrangement allows access to all operating mechanisms for inspection, maintenance and other functions without breaking the isolation of the containment region. The doors 16 and 18 are driven and operated by linear door actuators 32 and 33, in particular, ball screw mechanisms of the type shown generally in FIG. 1. These door actuators 32 and 33 provide mechanical outputs in response to a sequencing mechanism coupled to a main drive shaft 34.

The main drive shaft 34 is a single drive shaft with a plurality of axially aligned sections 34*a* joined by shaft couplings 34*b*. The main drive shaft 34 can be rotated either clockwise or counterclockwise when operated manually through any one of three handwheels 35–37 or when operated automatically by a motor 19. The handwheels 35–37 are located at three stations, one in the containment region 13, one in the transfer chamber 14, and the other in the shielded or atmospheric region 15. The handwheels 35–37 are coupled to the main shaft 34 through handwheel clutches 38–40. The handwheel clutches 38–40 are engaged by pulling the handwheels 35–37 outwardly along their respective shaft axes and away from their respective gear couplings to the main drive shaft 34. Key locks 57–59 are installed on the handwheel clutches 38–40 to enable the locking of the handwheels 35–37 in the disengaged position. The handwheel clutches 38–40 prevent the non-selected handwheels from turning during manual operation, and prevent all of the handwheels 35–37 from turning during automatic operation.

The handwheels 35–37 are more particularly coupled to the main drive shaft 34 as follows. The handwheel 35 in the containiment region 13 is coupled through its handwheel clutch 38 to a spur gear 41 that engages another spur gear 42 on the main drive shaft 34. The handhweel 36 in the lock transfer chamber 14 is coupled through it handwheel clutch 39 and two beveled gears 43 and 44 to a shaft 45. This shaft 45 carries a spur gear 46 that engages an idler gear 47, which couples the spur gear 46 to another spur gear 48 on the main drive shaft 34. This transfer gearing couples the handwheel 36 to the main drive shaft 34 to impart rotation in either the clockwise or counterclockwise direction. When coupled to the main drive shaft 34, the handwheels 35–37 are coupled to drive first one door and then the other. The handwheel 37 in the atmospheric region 15 is similarly coupled through its clutch 40 to two beveled gears 49 and 50, a shaft 51, a spur gear 52, an idler gear 53, and another spur gear 54 on the main drive shaft 34. One beveled gear 50, however, is also engaged by a beveled gear 55 that is driven through a shaft 56 by the motor 19, which is coupled at all times to the main drive shaft 34. The motor 19 and its associated controls (not shown) are selected so that when the motor 19 is deenergized its rotor is moved relatively easily in either a clockwise or counterclockwise direction as the handwheels 35–37 are manually operated. The motor 19 is also of the type that can be operated in either forward or reverse direction to impart either clockwise or counterclockwise rotation to the drive shaft 34.

The main drive shaft 34 is coupled to the door actuators 32 and 33 at the handwheel stations in the atmospheric region 15 and in the lock transfer chamber 14. The main drive shaft 34 carries two beveled gears 60 and 61 that are engaged full time to two beveled gears 62 and 63, which are part of two dual clutch mechanisms 64 and 65. The beveled gears 62 and 63 in the dual clutch mechanisms 64 and 65 are carried by clutch shafts 66 and 67, respectively, and when one of these clutch shafts 66 and 67 is engaged, motion is transmitted through a respective spur gear set to a respective door actuator 32 and 33. When the clutch shafts 66 and 67 are disengaged, they are still driven by the main drive shaft 34, but they do not transmit mechanical power to the spur gears 68 and 69. The engagement and disengagement of the clutch shafts 62 and 63 is controlled through a pair of lead screw timing assemblies 72 and 73, which are geared to the main drive shaft 34 at the handwheel stations in the lock transfer chamber 14 and in the atmospheric region 15.

Still referring to FIG. 1, the lead screw timing assemblies 72 and 73 include lead screws 74 and 75 that are extended portions of the shafts 45 and 51, respectively, which are driven with the main drive shaft 34 through the transfer gearing. Lead screw nuts 76 and 77 are in threaded engagement with the lead screws 74 and 75 and are advanced along the lead screws 74 and 75 in a direction determined by the threading and direction of rotation of the lead screws 74 and 75. The lead screw assemblies 72 and 73 control the engagement of the clutch mechanisms 32 and 33 through a pair of forked, clutch-actuating members 78 and 79 seen in FIGS. 1 and 3. These clutch-actuating members 78 and 79, as well as a pair of mechanically actuated vent valves 80 and 81 are operated through cam mechanisms (not seen in FIG. 1) that are tripped as the lead screw nuts 76 and 77 advance past them along their respective lead screws 74 and 75. Thus, as shall be explained in more detail below, the lead screw assemblies 72 and 73 control the sequence of operation of the vent valves 80 and 81 and the opening and closing of the two doors 16 and 17.

Besides driving the doors 16 and 17 between their open and closed position, the door actuators 32 and 33 also lock and unlock latching mechanisms on the doors 16 and 17. Referring particularly to the outer door 17 in FIG. 1, a ball screw nut 82 advances outwardly along a threaded ball screw 83. A link plate 84 couples the ball screw nut 82 to a pivot link 85. The pivoting of the pivot link 85 retracts another link 86, which is coupled to two toggle links 87 and 88, thereby pulling the toggle links 87 and 88 back from an over center position and releasing a latch arm 89. When the ball screw nut 82 is returned to its "home" position and the toggle links 87 and 88 are pushed to their over center position, as seen on the inner door 16, a latch arm 89 is forced by lever action against a latching side door jamb 90 to lock the inner door 16. Such a latching mechanism can be adjusted for various pre-loads to meet seal test pressure and containment negative pressure specifications.

At the beginning of the air lock operating sequence for entering the containment region 13, both doors 16 and 17 are closed and the timing level screw assemblies 72 and 73 are in a neutral position. In the "neutral" position the lead screw nuts 76 and 77 are medial the ends of their respective lead screws 74 and 75 as seen in FIG. 2. The outer door operation is summarized in six steps that occur between the time the lead screw unit 77 leaves it neutral position until its return. The first three steps occur as the main drive shaft 34 is rotated in a counterclockwise direction, while the last three steps occur as the main drive shaft 34 is rotated in a clockwise direction.

TABLE I

| Outer Door Operating Sequence | | |
|---|---|---|
| Step | Rotation of Main Shaft | Description |
| | None | Neutral Position |
| 1 | CCW | Vent Valve Opens |
| 2 | CCW | Outer Door Latch Unlocks and Retracts |
| 3 | CCW | Outer Door Swings Open |
| 4 | CW | Outer Door Swings Closed |
| 5 | CW | Outer Door Latch Extends and Locks |
| 6 | CW | Outer Vent Valve Closes |
| | None | Return to Neutral Position |

After the outer door 17 has been opened and closed, the inner door operating sequence is initiated either automatically or by operating the handwheel 36 in the lock chamber 14. The inner door operating sequence is summarized in Table II below. It should be noted that the main shaft 34 continues rotating in a clockwise direction for the first three steps of the inner door sequence, as it did for the last three steps of the outer door sequence.

TABLE II

| Inner Door Operating Sequence | | |
|---|---|---|
| Step | Rotation of Main Shaft | Description |
| | None | Neutral Position |
| 1 | CW | Vent Valve Opens |
| 2 | CW | Inner Door Latch Unlocks and Retracts |
| 3 | CW | Inner Door Swings Open |
| 4 | CCW | Inner Door Swings Closed |
| 5 | CCW | Inner Door Latch Extends and Locks |
| 6 | CCW | Inner Vent Valve Closes |
| | None | Return to Neutral Position |

As seen in FIG. 2, the lead screw nuts 76 and 77 are marked to form pointers for a pair of control panels 92 and 93 at the handwheel stations in the transfer chamber 14 and atmospheric region 15, respectively. The lead screw nuts 76 and 77 not only control the sequence of air lock operation, but they also indicate the current operating point in that sequence by pointing to reference marks on the labels 94 seen in FIG. 2. Two of these labels 94 show an open, a closed, and a locked or latched position for the inner and outer doors 16 and 17, respectively. Two other labels 94 show open and closed positions for the inner and outer vent valves 80 and 81, respectively. When the screw nuts 76 and 77 are between the labels 94 for the inner and outer vent valves 80 and 81, they are in the "neutral position" referred to above. It should be noticed that the position of the labels from left to right for the control panel 92 in the transfer chamber 14 is reversed from that of the control panel 93 in the atmospheric region 15, and that the pointers (lead screw nuts 76 and 77) move in opposite directions along their respective lead screws 74 and 75. Also located on the control panels 92 and 93 are air pressure gauges 95 for observing the air pressure in the containment region 13, the lock transfer chamber 14, and the atmospheric region 15.

Each lead screw nut 76 and 77, as exemplified by the lead screw nut 77 at the shield side handwheel station in FIGS. 2 and 3, advances from the "neutral position" towards the left end of its lead screw 75, to operate in its "active" range, where it actuates the door-operating mechanism. As seen in FIG. 4, a first cam 96 for operating the outer vent valve 81 has a pair of trip fingers 96*a* and 96*b* disposed 90° apart and rotated 90° clockwise from an initial position due to the passage of a cam actuator 91 on the lead screw nut 77. A finger 96*b* that extends laterally to the right has also been rotated 90° so that it is now in the position of the first finger 96*a*. Opposite this second finger 96*b* is a cam lobe 96*c* that is rotated up to a position at the top of the cam when the cam 96 is rotated 90° in the clockwise direction. Similarly, a second cam 97 for operating the clutchactuating member 79 has fingers 97*a* and 97*b* and a lobe 97*c* in the same configuration which are rotated by the action of the cam actuator 91.

The lower cam finger 96*a* on the first cam 96 is tripped as the screw nut 77 advances along the lead screw 75, and the cam lobe 96*c* is urged against a transverse valve-actuating link 98. This link 98 then moves upward, as does a vertical valve-actuating link 99 coupled to it to open the outer vent valve 81. The lead screw nut 77 then proceeds along its lead screw 75 to trip the finger 97*a* on the second cam 97 and urge the cam lobe 97*c* against the transverse clutchactuating member 79. The clutch mechanism 65 includes an upper clutch disc 100, seen better in FIG. 5, which is moved downward with the forked end of the pivotable clutch-actuating member 79 to cause engagement of a door-opening clutch 101.

The door-opening clutch 101 encircles the upper end of clutch drive shaft 67, and when engaged, couples the clutch drive shaft 67 through spur gears 69 and 71 to a vertically disposed worm gear drive shaft 104, included in the door actuator 33. The second spur gear 71 is coupled to worm gear drive shaft 104 through a unidirectional overrunning sprag clutch 105 for reasons to become apparent from the description below. The worm gear portion of the drive shaft 104 is not seen in FIG. 5 being obscured by the walls of a gear box 106 for the door actuator 33.

Extending laterally from the gear box 106 is a flange 107 that is received in a space between two other laterally extending flanges 108 and 109 on a door actuator mounting bracket 110 mounted on a wall 102 of the air lock 10. A sleeve 111 fits vertically through these flanges 107–109 and the clutch drive shaft 67 extends vertically through a hollow portion in this sleeve 111. An upper bearing assembly 112 encircles the clutch drive shaft 67 between the door-opening clutch 101 and the upper flange 108 on the mounting bracket 110, while a lower bearing assembly 113 encircles the clutch drive shaft 67 between the lower flange 109 on the mounting bracket and a door-closing clutch 114.

The door-closing clutch 114 is mounted on the lower end of the clutch drive shaft 67 and when its clutch disc 115 is thrown approximately one-half inch axially upward by another clutch-actuating member 116, the clutch drive shaft 67 is coupled through spur gears 117 and 118 to the worm gear drive shaft 104.

In the preferred embodiment, the door-opening clutch 101 and the door-closing clutch 114 are Maxitorq Standard Floating Disc No. 23 Clutches, manufactured by the Carlyle Johnson Machine Company of Manchester, Conn. The unidirectional overrunning sprag clutch 118 is a Model FSR-8 Clutch available from Formsprag of Warren, Mich.

Referring to FIGS. 6 and 7, after the door opening clutch 101 is engaged, and the ball screw 83 begins to rotate, the ball screw nut 82 begins to advance outwardly along the screw 83. As seen in FIG. 7, the ball screw nut 82 is fastened to the back end of a trunnion sleeve 120. A trunnion nut 121 is mounted on top of this trunnion sleeve 120 and moves in an upper slide frame 122 that is fastened to the top side of an actuator frame 123 that houses the ball screw mechanism. An upper trunnion 125 is fastened to a portion of the trunnion sleeve 120 that projects upwardly through the trunnion nut. A catch 126 has an end pivotally mounted near one end of the upper slide frame 122 and has an opposite end with a detent 127 positioned to engage the upper trunnion 125 when it reaches the outer end of the upper slide frame 125.

After the door-opening clutch 101 is engaged to couple the actuator 33 to the main drive shaft 34, the upper trunnion 125 begins to move from its "home" position at the inner end of the upper slide frame 122 towards the outer end of the slide frame 122. During this portion of travel, the latch mechanism is operated so that the latch arm 89 in FIG. 1 is pivoted off a door jamb 119 to a position where it will pass through the doorway 18 as the door 17 is opened. Referring again to FIG. 7, when the trunnion 125 reaches the outer end of the slide frame 122, the further movement of the ball screw nut 82 will push on the entire door-hinge structure to open the door 17 and push it inwardly into the transfer chamber 14 as seen in FIG. 1. At this point, the detent 127 formed in the catch 126 will retain the upper trunnion 125 at the end of the outer end of the slide frame 122 as seen in phantom in FIG. 6. Otherwise, the initial retract motion of the trunnion nut 121 would force the latch to extend and prevent the door from closing.

Figure 5:
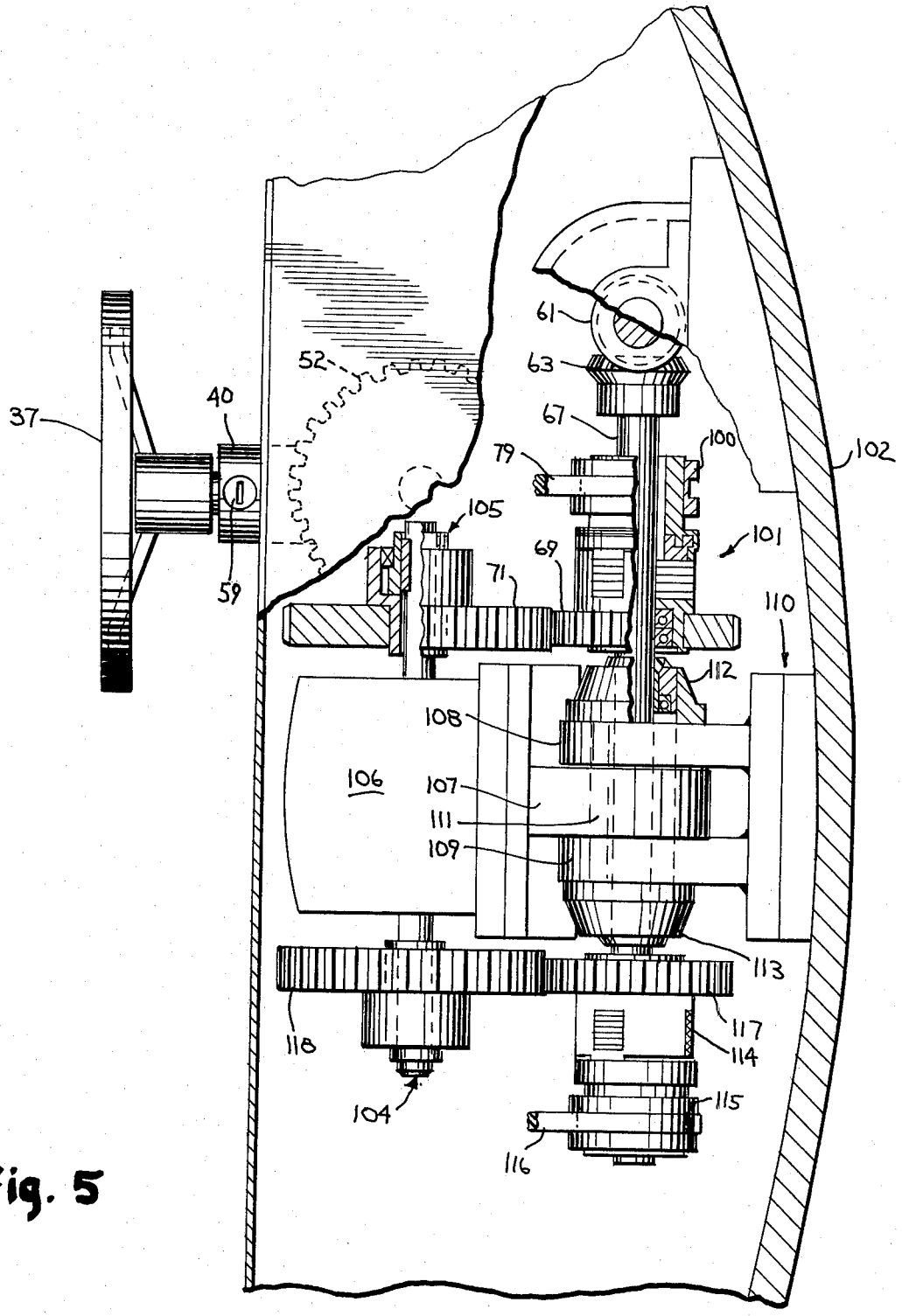
FIG. 5 is a side elevational view of the dual clutch mechanism that couples the main drive shaft to the outer door actuator of FIG. 1.

Referring now to FIGS. 5, 8 and 9, the door-closing clutch 114 is engaged after the outer door 17 is unlocked but before it is moved from its closed position. As seen in FIG. 8, the disc 115 on the door closing clutch 114 is thrown upward by the forked end of a door-closing clutch actuating member 116 when the other end of that member 116 is pivoted downward. That other end is connected to a depending member 130 with a yoke at its lower end and a pin 131 journaled through the yoke. The pin 131 is coupled to one end by a coupling member 132 that encircles a horizontally disposed coupling shaft 133 at its other end and extends radially therefrom. This horizontally disposed shaft 133 is carried in a pair of bearings 134 and 135 at its opposite ends. A radially extending arm 136 is laterally spaced from the coupling member 132 and is engaged by a horizontally rotating arm 137 on the bottom of a shaft 138, which extends vertically through the lower hinge pin 31 for the outer door 17. This slightly rotatable shaft 138 is supported by a bracket 139 mounted on the outer bulkhead 12 and extends upwardly to the level of the door actuator 33 on the outer door 17.

Referring particularly to FIG. 9, the upper end of the shaft 138 is keyed to one end of the short, pivotable link 139, the other end of this link 139 being connected to a variable length arm 140. The other end of this arm 140 is connected to one end of a spring-loaded bell crank lever 141, the other end of the bell crank 141 having a roller 142 mounted thereon. The roller 142 is positioned to be driven and released by a rearwardly extending plate 143 mounted on a bottom trunnion nut 144. These portions of the trunnion sleeve 120 move in a bottom slide frame 145, also seen in FIG. 7. Thus, when the trunnion 125 and ball screw nut 82 are in their "home" position, the clutch disc 115 in FIG. 8 is in its disengaged position, and when the trunnion sleeve 120 moves away from its home position, the clutch disc 115 is moved upwardly to cause engagement at the door-closing clutch 114. The pivoting of the clutch-actuating member 116 is caused by the rotation of the arm 137 about the axis of the shaft 138, which is translated to pivotal movement of the radial arm 136 and the coupling member 132, to pull the member 130 downward. Thus, it can be seen from FIGS. 5, 8 and 9 that, after the ball screw nut 82 moves a short distance to effect the unlocking of the outer door 17, the doorclosing clutch 114 is engaged.

As the outer door 17 is opened, it is driven through the door-opening clutch 101 seen in FIG. 5, and at the fully open position the pointers (lead screw nuts 76 and 77) are in the position shown in FIG. 2. The direction of rotation of the main drive shaft 34 in FIG. 4 is then reversed, the pointers are moved back to their neutral positions, and the outer door 17 is driven through the door-closing clutch 114 seen in FIG. 5.

Referring to FIG. 6, when the door-hinge supports 22 and 23 are moved back to near their position when the door 17 is closed, the pivotal catch 126 cams on an extension bracket 146 mounted on the outer bulkhead 12. This releases the trunnion 125 to begin its travel back toward its home position. In this way the door is first closed by the return drive of the door actuator 33 through the door-closing clutch 114 and is then locked by driving the latching mechanism in the last part of the door-closing cycle.

After the outer door 17 is closed and locked, the lead screw nuts 76 and 77 on the timing mechanisms will continue to move back from their positions in FIG. 2 towards their neutral positions. Between the time that the trunnion 125 reaches its home position and the time that the door-opening clutch 101 is disengaged, the output gear 71 overruns the actuator drive shaft 104 due to the action of the sprag clutch 105. The lead screw nut 77 will trip the cam fingers **96*b* and 97*b* in FIG. 4 and drive the cams 96 and 97 ninety degrees in the counterclockwise direction to disengage the door-opening clutch 101 and close the outer vent valve 81. The main drive shaft 34 is now rotating in the clockwise direction and further rotation after the lead screw nuts 76 and 77** have reached their neutral position will begin the inner door operating sequence outlined in Table II above.

The clutch-actuating members and clutch mechanism for the inner door 16 operate in the same manner as described for the outer door 17. Whereas the lead screw nut 75 was driven through the left-hand or active range along the lead screw 77 when the main shaft 34 was rotating in a counterclockwise direction, the lead screw nut 76 for the inner door 16 will move in that direction when the main drive shaft 34 is rotated in a clockwise direction. In this embodiment, this result is achieved by threading the lead screw 75 and the lead screw nut 77 for the outer door 17 with right-hand threads and threading the lead screw 74 and the lead screw nut 76 for the inner door 16 with left-hand threads, however, it should be apparent that other gearing arrangements could be employed to achieve this result.

It should be recognized that certain other details of the invention may vary in other embodiments. For example, the cam arrangement in which the lead screw nuts actuate cams to operate the vent valves and clutch-actuating mechanisms could be varied so that a cam on each lead screw nut travels in a groove, and maintains positive contact with the valve and clutch actuators. Also, other suitable types of linear actuators besides ball screws can be employed. And, although for puposes of illustration the door hinge supports 20–21 and 22–23 are shown rigidly connected to the doors 16 and 17, the hinge supports 20–21 and 22–23 could also be pivotally connected to the doors 16 and 17 so that the doors 16 and 17 are articulated for uniform seating in the doorways. In view of these possible variations, reference is made to the following claims for defining the scope of the invention.

What has been described is a unique, air lock door sequencing mechanism that employs a single drive shaft, which is driven in an automatic operating mode by a motor 19, and which is driven in a manual mode through any one of three handwheels 35–37. The handwheel 35 in the containment region drives a pair of lead screw timing assemblies 72 and 73 through the single drive shaft 34, while the other handwheels 36 and 37 are each directly geared to one of the timing assemblies 72 and 73 and are coupled to the other timing assembly through the main drive shaft 34. The handwheels 35–37 are coupled to the drive shaft 34 through handwheel clutches 38–40 which are locked to prevent the handwheels 35–37 from rotating when not being turned by an operator. The door-actuators 32 and 33 are located on the opposite-from-containment side of the doors 16 and 17 and are coupled to the drive shaft 34 through clutch mechanisms to complete the drive linkage for the door control system.

We claim:

1. A door control system for opening an outer door of an air lock for entry into the lock chamber from the outside and for opening an inner door for leaving the lock chamber to enter a pressurized region, the door control system comprising:

first door-actuating means for operating the outer door between a locked, closed position and an open position;

means for connecting the first door-actuating means to the outer door;

second door-actuating means for operating the inner door between a locked, closed position and an open position;

means for connecting the second door-actuating means to the inner door;

a drive shaft;

first clutch means for coupling and decoupling the drive shaft to the first door-actuating means;

second clutch means for coupling and decoupling the drive shaft to the second door-actuating means;

first clutch-actuating means for engaging and disengaging the first clutch means;

a first lead screw assembly including a first lead screw coupled to the drive shaft to be rotatably driven thereby, and also including a first lead screw nut that advances along the first lead screw to operate the first clutch-actuating means;

second clutch-actuating means for enagaging and disengaging the second clutch means;

a second lead screw assembly including a second lead screw coupled to the drive shaft to be rotatably driven thereby, and further including a second lead screw nut that advances along the second lead screw to operate the second clutch-actuating means; and means coupled to the drive shaft for imparting rotation to the drive shaft and the lead screws coupled thereto, wherein the lead screw nut assemblies alternately operate their associated clutch-actuating means to alternately operate the doors.

2. The door control system of claim 1, further comprising an outer vent valve and an inner vent valve, wherein the outer vent valve is opened in response to the advance of the first lead screw nut before the outer door is opened, and wherein the inner vent valve is opened in response to the advance of the second lead screw nut before the inner door is opened.

3. The door control system of claim 1, wherein the first and second lead screw assemblies are adapted so that the first lead screw nut moves along the first lead screw in a direction opposite the movement of the second lead screw nut along the second lead screw.

4. The door control system of claim 1, wherein one lead screw and its associated lead screw nut have right-hand threads and wherein the other lead screw and its associated lead screw nut have left-hand threads.

5. The door control system of claim 1, wherein:

each clutch means includes a door-opening clutch and a door-closing clutch;

wherein each clutch-actuating means includes one portion adapted to engage the door-opening clutch to drive its associated door towards its open position, and another portion adapted to engage the door-closing clutch to drive its associated door towards its locked position; and wherein the portion controlling the engagement of each door-opening clutch is operated in response to the advance of a respective lead screw nut, and wherein the portion controlling the engagement of the door-closing clutch is operated in response to the operation of a respective door-actuating means.

6. The door control system of claim 5, wherein each door-opening clutch is coupled to a respective door-actuating means through an overrunning clutch so that as a door is being closed from an open position its associated door-actuating means will be driven through a door-closing clutch.

7. The door control system of claim 1, wherein:

each lead screw nut forms a pointer; and further comprising a pair of control panels each with an aperture aligned to permit viewing of a respective pointer, and with a plurality of reference marks along the edge of the aperture to form a slide-type indicator.

8. In an air lock with an outer door adapted to open and close in a doorway between an atmospheric region and a transfer chamber, and with an inner door adapted to open and close in a doorway between the transfer chamber and a containment region, a door control system comprising:

first door-actuating means for operating the outer door between a locked, closed position and an open position;

means for connecting the first door-actuating means to the outer door;

second door-actuating means for operating the inner door between a locked, closed position and an open position;

means for connecting the second door-actuating means to the inner door;

a drive shaft;

first clutch means for coupling and decoupling the drive shaft to the first door-actuating means;

second clutch means for coupling and decoupling the drive shaft to the second door-actuating means;

a first lead screw coupled to the drive shaft to be rotatably driven thereby;

first clutch-actuating means for engaging the first clutch means and thereby coupling the drive shaft to the first door-actuating means;

a first lead screw nut adapted to move in an active range along the lead screw, between a neutral position and one end of the first lead screw, to operate the first clutch-actuating means and the first clutch means, the first clutch means being disengaged when the first lead screw nut is moved in an inactive range between the neutral position and the other end of the first lead screw;

a second lead screw coupled to the drive shaft to be rotatably driven thereby;

second clutch-actuating means for engaging the second clutch means and thereby coupling the drive shaft to the second door-actuating means;

a second lead screw nut adapted to move in an active range between a neutral position medial the ends of the second lead screw and one end of the second lead screw to operate the second clutch-actuating means and the second clutch means, the second clutch means being disengaged when the second lead screw nut is moved in an inactive range between the neutral position and the other end of the second lead screw; and means coupled to the drive shaft for imparting rotation to the drive shaft and the lead screws coupled thereto, wherein the lead screws and lead screw nuts are adapted so that one lead screw nut moves in its active range along its lead screw to operate one door, while the other lead screw nut moves in an inactive range along its lead screw, whereby the other door remains in a locked, closed position.

9. The door control system of claim 8, wherein the first and second lead screws are adapted so that the first lead screw nut moves along the first lead screw in a direction opposite the movement of the second lead screw nut along the second lead screw.

10. The door control of claim 8, wherein one lead screw and its associated lead screw nut have right-hand threads and wherein the other lead screw and its associated lead screw nut have left-hand threads.

11. The door control system of claim 8, wherein:

each clutch means includes a door-opening clutch and a door-closing clutch;

wherein each clutch-actuating means includes one portion adapted to engage the door-opening clutch to drive its associated door towards its open position, and another portion adapted to engage the door-closing clutch to drive its associated door towards its locked position; and wherein the portion controlling the engagement of each door-opening clutch is operated by the movement of a respective lead screw nut in its active range, and wherein the portion controlling the engagement of each door-closing clutch is responsive to the operation of a respective door-actuating means through a respective door-opening clutch to engage its associated door-closing clutch.

12. The door control system of claim 11, wherein each door-opening clutch is coupled to a respective door-actuating means through an overrunning clutch so that as the door is being closed from an open position its associated door-actuating means will be driven through a door-closing clutch.

13. The door control system of claim 8, wherein:

each lead screw nut forms a pointer; and further comprising a pair of control panels each with an aperture aligned to permit viewing of a respective pointer, and with a plurality of reference marks along an edge of the aperture to form a slide-type indicator.

14. The door control system of claim 8, further comprising:

first vent valve means for controlling the pressure differential between the atmospheric region and the transfer chamber;

further comprising second vent valve means for controlling the pressure differential between the transfer chamber and the pressurized region;

further comprising means for coupling one lead screw nut to the first vent valve means to open the first vent valve means before opening the door controlled by that lead screw nut and for closing the first vent valve after closing the door controlled by that lead screw nut; and further comprising means for coupling the other lead screw nut to the second vent valve means to open the second vent valve means before opening the door controlled by the other lead screw nut and for closing the second vent valve means after closing the door controlled by that other lead screw nut.

15. A door control mechanism for a door that is moved out of a doorway and outwardly from one side of a partition defining the doorway, the partition including two upright, spaced apart door jambs on opposite sides of the doorway, the mechanism comprising:

a latch arm;

means for pivotally connecting the latch arm to the door;

an actuator link;

a first toggle link coupled between the latch arm and the actuator link;

a second toggle link with one end coupled to the actuator link and a pivot end for connection to the door;

means for connecting the pivot end of the second toggle link to the door;

door actuator means coupled to the actuator link for operating the toggle links between (i) an over-center position where the latch arm engages one of the door jambs to hold the door in a locked, closed position and (ii) a back-from-over-center position where the latch arm is pivoted inwardly from the door jamb and the door actuator means begins to urge the door to its open position, wherein the latch arm, the toggle links, the actuator link and the door actuator means are all disposed on the side of the partition opposite the side to which the door is opened, the latch arm, the toggle links and the actuator link being urged through the doorway to the other side of the partition when the door actuator means is operated to urge the door to its open position.

16. The mechanism of claim 15 wherein the partition has a containment side that faces a containment region and has an opposite-from-containment side, and wherein the latch arm, the actuator link and the toggle links are positioned on the opposite-from containment side of the partition when the door is closed, and are moved through the doorway to the containment side of the partition as the door is opened.

17. A door control system for operating an outer door of an air lock for entry into the lock chamber from the outside and for operating an inner door for leaving the lock chamber to enter a pressurized region, the door control system comprising:

first door-actuating means for operating the outer door between a locked, closed position and an open position;

means for connecting the first door-actuating means to the outer door, this connecting means including latching means driven by the first door-actuating means;

second door-actuating means for operating the inner door between a locked, closed position and an open position;

means for connecting the second door-actuating means to the inner door, this connecting means including latching means driven by the second door-actuating means;

a single drive shaft;

first clutch means for coupling and decoupling the drive shaft to the first door-actuating means;

first clutch-actuating means for engaging and disengaging the first clutch means;

first timing means coupled to the drive shaft to be driven thereby, the first timing means having a portion that advances along a linear path to operate the first clutch-actuating means;

second clutch means for coupling and decoupling the drive shaft to the second door-actuating means;

second clutch-actuating means for engaging and disengaging the second clutch means;

second timing means coupled to the drive shaft to be driven thereby, the second timing means having a portion that advances along a linear path to operate the second clutch-actuating means; and means coupled to the drive shaft from imparting rotation thereto, wherein the first and second timing means are adapted to alternately operate their associated clutch-actuating means to alternately operate the doors.

18. The door control system of claim 17, wherein the advancing portions of the timing means move at the same time in opposite directions, and also move at different times in the same direction to operate the respective clutch-actuating means at different times in the door operating sequence.

19. The door control system of claim 17, wherein:

the first timing means includes a first lead screw assembly with a first lead screw coupled to the drive shaft to be rotatably driven thereby, and with a first lead screw nut that advances along the first lead screw to operate the first clutch-actuating means; and wherein the second timing means includes a second lead screw assembly with a second lead screw coupled to the drive shaft to be rotatably driven thereby, and with a second lead screw nut that advances along the second lead screw nut that advances along the second lead screw to operate the second clutch-actuating means.

20. The door control system of claim 17, wherein:

the means for imparting rotation to the drive shaft includes a handwheel coupled to the drive shaft through a handwheel clutch; and further comprising lock means on the handwheel clutch for locking the handwheel clutch in a position where the handwheel is prevented from driving the main drive shaft.

* * * * *